06-98 AU 113 EX
/26/78 XR 4,131,477

United States Patent [19]
Kagan et al.

[11] 4,131,477
[45] Dec. 26, 1978

[54] MOULDING COMPOSITION FOR MAKING FOUNDRY MOULDS AND CORES

[76] Inventors: Naum Y. Kagan, 2 ulitsa Mariinoi roschi, 14, kv. 48; Vladimir M. Bortnik, Eiskaya ulitsa, 8/29, kv. 36; Isai V. Korenbljum, Veernaya ulitsa, 3, korpus 4, kv. 112, all of Moscow; Jury A. Razumeev, Novomytischinsky prospekt, 39, kv. 1, Mytischi Moskovskoi oblasti; Abram M. Lyass, Sharikopodshipnikovskaya ulitsa, 2, kv. 42, Moscow; Pavel A. Borsuk, Nizhne-Pervomaiskaya ulitsa, 59, kv. 10, Moscow; Zokhrab G. O. Usubov, B. Cherkizovskaya ulitsa, kvartal 8-11, korpus 21, kv. 106, Moscow; Valentina A. Dmitrieva, ulitsa Trofimova, 25, kv. 43, Moscow, all of U.S.S.R.

[21] Appl. No.: 767,032

[22] Filed: Feb. 9, 1977

Related U.S. Application Data

[63] Continuation of Ser. No. 672,721, Apr. 1, 1976, abandoned, which is a continuation of Ser. No. 577,785, May 15, 1975, abandoned, which is a continuation of Ser. No. 439,980, Feb. 6, 1974, abandoned.

[51] Int. Cl.[2] ..... B28B 7/34
[52] U.S. Cl. ..... 106/38.35; 106/38.3; 106/38.5 R; 106/90; 106/92; 106/98; 106/104
[58] Field of Search ..... 106/38.5 R, 38.3, 38.35, 106/38.23, 123 LC, 123 R, 90, 92, 38.6, 98, 93, 104

[56] References Cited

U.S. PATENT DOCUMENTS

| | | | |
|---|---|---|---|
| 2,863,781 | 12/1958 | Wallace et al. | 106/38.8 |
| 3,275,460 | 9/1966 | Jeanneret | 106/38.22 |
| 3,804,641 | 4/1974 | Lyass et al. | 106/38.2 |

FOREIGN PATENT DOCUMENTS

| | | | |
|---|---|---|---|
| 1029809 | 5/1966 | United Kingdom | 106/38.9 |

*Primary Examiner*—Lorenzo B. Hayes
*Attorney, Agent, or Firm*—Holman & Stern

[57] ABSTRACT

A moulding composition for making foundry moulds and cores which comprises: foundry sand as a filler; a ligno-sulphonate of an alkali metal, an alkali earth metal, an ammonium or mixtures thereof as a binding ingredient; and a phenol or mixture of phenols as an additive.

The composition provides for high strength (between 10 and 30 kg/cm$^2$) moulds and cores made therefrom, including those intended for big castings. The process of preparing moulds and cores is simple if the said composition is to be used, due to the fact that the labor requirements for packing the composition are reduced, as is the time of drying. Furthermore, moulds and cores made from the composition disclosed give a better impression of the pattern from which there is practically no dropping out.

43 Claims, No Drawings

MOULDING COMPOSITION FOR MAKING FOUNDRY MOULDS AND CORES

This is a continuation of application Ser. No. 672,721, filed Apr. 1, 1976 which in turn is a Rule 60 Continuation of U.S.S.N. 577,785, filed May 15, 1975, which, in turn, is a Rule 60 Continuation of U.S.S.N. 439,980, filed Feb. 6, 1974, all of which are now abandoned.

The present invention relates to founding, and more specifically to a moulding composition for making foundry moulds and cores.

Moulding compositions used in making foundry moulds and cores are widely know in the art, said compositions comprising foundry sand as a filler, a binding ingredient and additives. In particular, these compositions employ a ligno-sulphonate of an alkali metal, an alkali earth metal, an ammonium or mixtures thereof as the binding ingredient. The most common type of material containing ligno-sulphonates is exemplified by what is called sulphite lye solids which is waste resulting from the sulphite process in the production of wood pulp.

Foundry moulds and cores made from compositions containing sulphite lye solids with a density of between 1.25 and 1.27 g/cm$^3$ as the binding ingredient in an amount of 3 or 4% by weight of the foundry sand are commonly dried at a temperature of between 160° and 180° C. in order to impart to them the requisite strength. Yet, their compressive strength never exceeds from 6 to 8 kg/cm$^2$, which being a factor limiting the scope of application particularly when a big mould or core is required. The drying period in this case is a protracted one with the result being that the output of drying ovens is low and so is the productivity per unit production area.

In order to enhance the strength of said compositions, additives such as urea may be used by way of illustration. However, the nitrogen present in urea causes flaws in steel castings, mainly in the form of pin holes.

In an effort to eliminate said disadvantages, the introduction of self-setting moulding compositions incorporating sulphite lye solids as the binding ingredient was attempted in recent years. A self-setting moulding composition employing sulphite lye solids as the binding ingredient and compounds of hexavalent chromium as the additive which provides for the self-setting properties is also known.

However, these compositions lack the requisite high strength and the control of their properties poses a number of problems. Apart from that, the compounds of hexavalent chromium contained in said compositions as the additive which provides for self-setting properties are toxic materials.

The primary object of the present invention is to provide a moulding composition for making foundry moulds and cores which would assure high strength properties for the moulds and cores (between 10 and 30 kg/cm$^2$ in compression).

Another object of the invention is to provide such a moulding composition which would simplify the technique of making moulds and cores by reducing the labor requirements for pouring the liquid mixture on patterns and into core boxes and by reducing the drying time or eliminating the drying all together.

A further object of the present invention is to provide such a moulding composition which would enable the fabrication including those for big castings, having of superior quality than moulds and cores made from the known compositions; this implies a better pattern impression and practically total freedom from drop outs in both moulds and cores.

Said and other objects are attached by the fact that in a moulding composition for making foundry moulds and cores comprising foundry sand as a filler, a ligno-sulphonate of an alkali metal, an alkali earth metal, an ammonium or mixtures thereof as a binding ingredient, and an additive, and according to the invention, a phenol or a mixture of phenols is used as said additive.

It has been discovered that phenols plasticize sulphite lye solids if introduced into same. In this connection it has been suggested that phenols added to a composition containing sulphite lye solids as a binding ingredient may facilitate the formation of continuous films free of cracks and other defects after drying. Investigations carried out with moulding compositions with sulphite lye solids and phenol additives have corroborated the suggestion.

A phenol or a mixture of phenols, if used in moulding compositions as additives, is a means of increasing the strength of these compositions and, consequently, the strength of the moulds and cores made therefrom. The use of phenols substantially simplifies the technique of preparing moulds and cores, which factor cutting the labour requirements for completing the ramming, shortens the casting cycle, which minimizes the damage to the cores and moulds in handling some, reduces the number of gaggers and arbors used, eases the reinforcement of moulds and cores.

Moreover, the high strength of the compositions varying over the range of 10 to 30 kg/cm$^2$ in compression is conductive to the high strength of moulds and cores which thus become suitable for use in the fabrication of big castings.

It has been found that the said properties and virtues of a composition comprising foundry sand, a binding ingredient in the form of a ligno-sulphonate of an alkali metal, an alkali earth metal, an ammonium or mixtures thereof and an additive in the form of a phenol or a mixture of phenols then become evident in the most efficient way when the phenol is present in the composition in an amount of between 0.05 and 5% by weight of the foundry sand.

A phenol content of the composition utilized in an amount of less than 0.05 wt% fails to produce the desired effect on the properties of the composition whereas a phenol content in excess of 5 wt % is unacceptable for reasons of economy. Furthermore, a considerable amount of gases formed while casting metal may lead to blow holes in the castings.

In order to enable said properties to manifest themselves in the most complete way, it is advisable to maintain the phenol-to-ligno-sulphonate within the range of between 1:3 and 1:7 depending on the phenol used. Said range of ratios has been selected because the plasticizing properties of phenol are optimum in this range. A higher phenol-to-ligno-sulphonate ratio imparts higher plasticity to the composition but prevents the phenol from displaying in full its potentialities as a strength-improving agent, whereas a lower phenol content leads to more frequent drop outs within moulds and cores made from the composition.

An exemplary phenol is hydroquinone taken in a ratio of 1:3 for the hydroquinone to ligno-sulphonate in the composition.

resorcin which is advisably taken in a ratio amount of 1:4 of the resorcin to ligno-sulphonate in the composition.

It is expedient and highly advisable from the standpoint of good economy to use as a waste mixture of phenols obtained during partial carbonization of coal. The waste, a dark brown liquid, contains between 30 and 60% phenolics and derivatives thereof, which are mainly resorcin and its derivatives.

In order to obtain a self-setting composition having a high mechanical strength ranging from 15 to 30 kg/cm$^2$, it is preferable to incorporate a hydraulic binder into the moulding composition taken in an amount of between 0.5 and 10% by weight of the foundry sand.

It is known that a hydraulic binder, if introduced into moulding compositions comprising foundry sand and a binding ingredient in the form of ligno-sulphonates, contributes to an increase in strength after a period between 48 and 72 hrs due to hydration. However, the phenol present in the moulding compositions drastically reduces the setting time of the hydraulic binders simultaneously with a considerable increase in the strength thereof during the self-setting. The said amount of hydraulic binder assures the most complete utilization of its binding properties. Portland Cement can be used to advantage as a hydraulic binder or such material as metallurgical slag.

Proceeding from the assumption that a phenol in conjunction with a ligno-sulphonate of an alkali metal, an alkali earth metal, an ammonium or mixtures thereof, i.e., sulphite lye solids, produces a plasticizing effect on the composition and also contributes, due to its tendency to oxidize, to the formation of free radicals which, in their turn, lead to polymerization and the formation of new compounds in the moulding compositions; further, it is advisable also to introduce oxidizing agents, compounds of metals having variable valency, or compounds of elements having amphoteric properties into the composition which materials serve to increase the strength. The addition of said compounds and oxidizers increases the rate of polymerization and the formation of new compounds and is conductive to an increase in the strength of the composition and, consequently, in the strength of the moulds and cores made therefrom.

It is preferred that an oxidizing agent be present in the moulding composition in an amount or from 0.01 and 2.0% by weight of the foundry sand. Such amounts of the oxidizing agent assures the formation of free radicals, due to the oxidation of the phenols, in amounts which are sufficient to stimulate polymerization chain reactions and the formation of new compounds in the normal way. The strength of the compositions after the introduction of the oxidizing agent is as high as 25 kg/cm$^2$.

Potassium permangenate may be used advantageously as an oxidizer in that is creates conditions for the controlling the setting process in the most promising way.

It is also preferred, for the purpose of increasing the strength while taking into account the above properties of the phenol, that compounds of metals having variable valency be present in the moulding composition in an amount of between 0.01 and 2.0% by weight of the foundry sand. Such amounts for the variable valency metal compounds being incorporated into the moulding composition serves to maintain a sufficiently high rate of ion-exchange reactions for the chain reactions of polymerization with the formation of new componds taking place.

An example of such suitable compounds which are capable of both reducing and oxidizing depending on the condition of the medium is manganese dioxide, thus adding thereby to the strength of the composition.

As a further means of increasing the strength of moulding composition an additive in the form of a compound of an element having amphoteric properties may be used. As pointed out earlier, upon interacting with phenols said compound favourably affects the process of polymerization and the formation of new compounds which take place in the composition and increases the strength of the composition. The preferable amount of a compound of an element with amphoteric properties in the moulding composition is between 0.5 and 3% by weight of the foundry sand. A content of below 0.5 wt % fails to produce an appreciable effect on the properties of the compositions whereas the presence of these compounds in the composition in an amount exceeding 3 wt % is unacceptable for reasons of economy.

Suitable compounds for use in the moulding composition is one containing an element with amphoteric properties such as titanium dioxide which is capable of taking part in reactions characteristic of both acid and alkaline oxides. Performing thus, the function of either the oxidizer or the reducer, titanium dioxide speeds up the reaction of polymerization and stimulating the formation of new compounds.

In order to eliminate the ramming of self-setting composition from the process of making foundry moulds and cores, the composition comprising foundry sand, ligno-sulphonate, phenol and a hydraulic binder may also contain, according to the invention, a surfactant with foam-generating properties taken in an amount of between 0.05 and 1.0% by weight of the foundry sand. Said surfactant eliminates the need in ramming the composition due to the fact that the foam produced turns the composition into a liquid which can be poured onto a pattern or into a core box rather than being strewn and rammed as is the case with solid moulding compositions.

A suitable foaming agent which may be used is sodium alkylaryl sulphonate. This agent displays a frothing effect which is sufficient to turn the composition into the liquid state and to keep the composition as a liquid as long as this is required in order to complete the pouring process of the composition into core boxes or onto patterns.

A further point to be noted in the invention is that it is advisable to dry the moulds and cores made from the moulding composition in accordance with the invention, using any of the techniques known, by heating to a temperature of between 160 and 180° C. or by blowing off with air or carbon dioxide. Said drying speeds up the process of setting and, consequently, the process of increasing the strength of the moulds and cores.

The present invention will be best understood from the following detailed description of the invention and examples of its specific embodiments.

The method of preparing a moulding composition for making foundry moulds and cores consists in the following.

Ligno-sulphonate of an alkali metal, an alkali earth metal, an ammonium or mixtures thereof acting in the capacity of a binding ingredient;, along with water and additives are added to the basic foundry sand component. In accordance with the invention, the said additives may be a phenol or a mixture of phenols. Said binding ingredient, water and additives can be introduced into the foundry sand all at once or during any sequence of events. The mixture is stirred for two or three minutes until it is a homogeneous one and then it is either strewn or poured onto a pattern or into a core box followed by moulding in any of the known ways, if necessary. In order to impart strength thereof, the mould or core is dried at a temperature of between 160° and 180° C. The cores can be dried while in the box or upon being removed from same. The cores can be made by using the known hot-box technique.

To give the cores and moulds the requisite strength in the green condition, clay may be introduced into the composition.

An increase in the strength of cores and moulds is also achievable by blowing them off with air, carbon dioxide, nitrogen or any other gas. This results either in a reduction of the drying time or the complete elimination of the drying of moulds and cores. If a hydraulic binder is employed in the composition, rendering the moulds and cores capable of self-setting in air, the blowing off with air or any other gas makes the process a more intensive one and adds to the strength of moulds and cores.

The sand used in the moulding compositions is of the common quartz type. Preference can also be given to olivine or circonium sands and a variety of other refractories such as magnesiochromite, chromite, etc. depending on the casting conditions or the presence of locally-available materials. All fillers like these contain, as a rule, compounds of metals with variable valency and of elements with amphoteric properties and, if used, impart extra strength to the composition.

In the moulding composition disclosed herein, a binding ingredient such as ligno-sulphonates of alkali metals, an alkali earth metals, an ammonium or mixtures thereof may be used. The most widely used material of this kind is sulphite lye solids. The sulphite lye solids used in the composition are available commercially in liquid and in dry (concentrated) form containing from 45 to 97% ligno-sulphonates by weight. The higher the ligno-sulphonate content of the sulphite lye solids, the less is the required amount of these solids in order to obtain the same strength characteristics of moulds and cores. Means for measuring the ligno-sulphonate content of sulphite lye solids in liquid form is by their density. The composition in accordance with the invention makes use of an aqueous solution of sulphite lye solids with a density of between 1.10 and 1.27 g/cm$^3$ and with a ligno-sulphonate content varying over the range of from 25 to 55% by weight.

The phenols employed herein may be selected from a group of derivatives of aromatic compounds having a hydroxyl group attached to a benzene ring carbon atom. In accordance with the invention, use can be made of a monoatomic phenol, a diatomic phenol (pyrocatechin, resorcinol, hydroquinone), a triatomic phenol (pyrogallol, phloroglucine, oxyhydroquinone); orto-, meta-, and para-cresol; as well as a mixture of phenols and their derivatives. A phenol can be introduced into the composition in pure form or in the form of phenol-containing materials which are products of processing wood, peat, oil-shale and coal. If the phenol-containing material from waste produced during the process of partial carbonization of coal, the results will be almost the same as with pure phenol but the cost of the composition will be lower, providing thereby for better economy.

The amount of phenols which is required in order to obtain the specified properties of the composition varies over the range of between 0.05 and 5% by weight of the foundry sand. A phenol-containing material must be taken in an amount which will assure said phenol content. However, a point to be noted is that the all-best results are obtained when there is a certain phenol-to-ligno-sulphonate ratio which varies over the range between 1:3 and 1:7 depending on the phenol used. If the phenol-to-ligno-sulphonate ratio is within said limits, the strength of the composition increases directly with the phenol content. When hydroquinone is used, the ratio is 1:3 and in the case of resorcin the ratio is 1:4.

To obtain a self-setting composition, a hydraulic binder is to be added to the composition in an amount between 0.5 and 10% by weight of the foundry sand. To prepare a composition like this, use is made of any of the known techniques, proceeding in the following sequence of events. Sand is mixed with a hydraulic binder and then a liquid compound comprising ligno-sulphonate, water and a phenol is introduced to the mixture. Stirring is continued for two or three minutes until the mix is a homogeneous one.

Moulds and cores made from such compositions are left in air for self-setting for a period between one hour and three hours depending on the size of the mould or core. The blowing off of moulds and cores with air or any other gas sharply increases the rate of setting and improves the strength of moulds and cores. At the same time, the period required for withdrawing patterns and taking apart core boxes is slashed to some 15-40 min depending on the size of the mould or core.

Used to advantage as a hydraulic binder can be a variety of cements such as, for example, portland cement, aluminate cement and alumina cement as well as metallurgical slags, including self-disintegrating slag from a ferro-chromium plant, blast furnace slag and steel refining slag. Also a mixture of slag and cement is suitable for use.

The foaming agent to be used in the composition can be a surfactant; an anionic, a cationic or a nonionogenic one; with foam-generating properties taken in an amount of from 0.05 and 1.0% by weight of the foundry sand. Suitable for use as such are alkylaryl sulphonates; alkyl sulphonates; primary and secondary alkyl sulphates; products of oxyethylation of fatty alcohols, acids, phenols, amines; quaternary ammonium compounds of long-chain fatty amines, and other.

Serving, for example, as the foaming agent can be sodium alkylaryl sulphonate which produces foam in the composition of a consistency and stability sufficient to render it pourable into a mould or core box.

To increase the strength, the composition also contains additives in the form of oxidizers, compounds of elements with amphoteric properties or compounds of metals with variable valency. Said additives are present in the composition in conjunction with phenols, each taken separately or one with another.

The oxidizer content of the composition is between 0.01 and 2.0% by weight of the foundry sand. Use can be made as an example of potassium permanganate. Other examples of an oxidizer are hydrogen peroxide and other peroxides, persulphates, perchlorate and the like.

A compound of a metal with variable valency, as one exemplified by manganese dioxide, is incorporated into the composition in an amount of between 0.01 and 2.0% by weight of the foundry sand. Coming under the category of compounds of metals with variable valency and also suitable for same use are hematite, iron scale, cuprous oxide and the like.

A compound of an element with amphoteric properties can be represented by titanium dioxide and is employed in the composition in an amount of between 0.05 and 1.0% by weight of the foundry sand. Other compounds of elements with amphoteric properties which can be incorporated into the composition are aluminium oxide, aluminates of alkali metals, zinc oxide and the like.

Said additives are introduced into the composition separately or upon being mixed with the bulk ingredients of the composition. In some instances they are dissolved in a liquid stock, this latter mode of introduction being true, as a rule, with respect to the oxidizers.

A number of concrete examples are given hereinbelow.

EXAMPLE 1

The ingredients of the composition were as follows (parts by weight):

| | |
|---|---|
| quartz sand | 100 |
| sulphite lye solids with a density of 1.22 g/cm$^3$ and a ligno-sulphonate contents of 43% | 4.2 |
| hydroquinone | 0.6 |
| water | 2.5 |

The hydroquinone-to-ligno-sulphonate ratio was 1:3.

The method of preparing the composition consisted in that the sulphite lye solids, water and hydroquinone was introduced into the sand all at once or in any sequence of events followed by mixing within a period of 2 or 3 min until a homogeneous mixture was obtained. Upon drying standard test pieces 50 mm high and with a diameter of 50 mm at 170° C. for 2 hours, they showed a compressive strength around 10 kg/cm$^2$.

EXAMPLE 2

The ingredients of the composition were as follows (parts by weight):

| | |
|---|---|
| quartz sand | 100 |
| sulphite lye solids with a density of 1.22 g/cm$^3$ and a ligno-sulphonate content of 43% | 2.8 |
| hydroquinone | 0.4 |
| water | 1.7 |

Upon blowing with compressed air for a period between 10 and 15 min, the compressive strength of a test piece made from the composition was 15 kg/cm$^2$.

EXAMPLE 3

The ingredients of the composition were as follows (parts by weight):

| | |
|---|---|
| quartz sand | 90 |
| portland cement | 10 |
| sulphite lye solids with a density of 1.22 g/cm$^3$ and a ligno-sulphonate content of 43% | 4 |
| hydroquinone | 0.7 |
| water | 1.6 |

The composition was prepared by mixing the sand with the portland cement and then a liquid mixture comprising the sulphite lye solids, water and hydroquinone premixed was added to the mixture in any sequence. Stirring went on for 2 or 3 min until a homogeneous mass was obtained. The compressive strength was as follows (kg/cm$^2$):

| | |
|---|---|
| after 1 hr | 4.0 |
| after 3 hrs | 8.0 |
| after 24 hrs | 22.0 |

EXAMPLE 4

The ingredients of the composition were as follows (parts by weight):

| | |
|---|---|
| quartz sand | 95 |
| portland cement | 5 |
| sulphite lye solids with a density of 1.22 g/cm$^3$ and a ligno-sulphonate content of 43% | 4 |
| hydroquinone | 0.4 |
| resorcin | 0.4 |
| water | 0.5 |
| The compressive strength was (kg/cm$^2$): | |
| after 1 hr | 4 |
| after 3 hrs | 12 |
| after 24 hrs | 23 |

EXAMPLE 5

The ingredients of the composition were as follows (parts by weight):

| | |
|---|---|
| quartz sand | 90 |
| slag from ferro-chromium plant | 10 |
| sulphite lye solids with a density of 1.22 g/cm$^3$ and a ligno-sulphonate content of 43% | 4 |
| hydroquinone | 0.4 |
| water | 0.5 |

The compressive strength was (kg/cm$^2$):

| | |
|---|---|
| after 1 hr | 2 |
| after 3 hrs | 4 |
| after 24 hrs | 17 |

EXAMPLE 6

The ingredients of the composition were as follows (parts by weight):

| | |
|---|---|
| quartz sand | 90 |
| portland cement | 10 |
| sulphite lye solids with a density of 1.22 g/cm$^3$ and a ligno-sulphonate content of 43% | 2.5 |
| water | 0.5 |
| waste from the partial carbonization of coal (phenol content 30%) | 3 |
| The compressive strength was (kg/cm$^2$): | |
| after 1 hr | 5.5 |
| after 3 hrs | 15.0 |
| after 24 hrs | 18.5 |

EXAMPLE 7

The ingredients of the composition were as follows (parts by weight):

| | |
|---|---|
| quartz sand | 95 |
| portland cement | 5 |
| sulphite lye solids with a density of 1.22 g/cm³ and a lignosulphonate content of 43% | 4 |
| hydroquinone | 0.4 |
| resorcin | 0.4 |
| water | 0.5 |

Upon blowing off a test piece with compressed air for a period between 10 and 15 min, the compressive strength reached 30 kg/cm².

EXAMPLE 8

The ingredients of the composition were as follows (parts by weight):

| | |
|---|---|
| quartz sand | 90 |
| portland cement | 10 |
| sulphite lye solids with a density of 1.22 g/cm³ and a lignosulphonate content of 43% | 4 |
| hydroquinone | 0.9 |
| potassium permanganate | 0.5 |
| water | 1.6 |
| The compressive strength was (kg/cm²): | |
| after 1 hr | 8 |
| after 3 hrs | 12 |
| after 24 hrs | 26 |

EXAMPLE 9

The ingredients of the composition were as follows (parts by weight):

| | |
|---|---|
| quartz sand | 90 |
| portland cement | 10 |
| sulphite lye solids with a density of 1.22 g/cm³ and a lignosulphonate content of 43% | 4 |
| hydroquinone | 0.9 |
| manganese dioxide | 0.8 |
| water | 1.6 |
| The compressive strength was (kg/cm²): | |
| after 1 hr | 5.5 |
| after 3 hrs | 10.5 |
| after 24 hrs | 24 |

EXAMPLE 10

The ingredients of the composition were as follows (parts by weight):

| | |
|---|---|
| quartz sand | 90 |
| portland cement | 10 |
| sulphite lye solids with a density of 1.22 g/cm³ and a lignosulphonate content of 43% | 4 |
| hydroquinone | 0.9 |
| titanium dioxide | 0.9 |
| water | 1.6 |
| The compressive strength was (kg/cm²): | |
| after 1 hr | 6 |
| after 3 hrs | 11 |
| after 24 hrs | 25 |

EXAMPLE 11

The ingredients of the composition were as follows (parts by weight):

| | |
|---|---|
| quartz sand | 90 |
| portland cement | 10 |
| sulphite lye solids with a density of 1.22 g/cm³ and a lignosulphonate content of 43% | 4 |

-continued

| | |
|---|---|
| hydroquinone | 0.9 |
| sodium aluminate | 0.5 |
| water | 1.6 |
| The compressive strength was (kg/cm²): | |
| after 1 hr | 6.5 |
| after 3 hrs | 12 |
| after 24 hrs | 25 |

EXAMPLE 12

The ingredients of the moulding composition in the liquid form were as follows (parts by weight):

| | |
|---|---|
| quartz sand | 90 |
| portland cement | 10 |
| sulphite lye solids with a density of 1.22 g/cm³ and a lignosulfonate content of 43% | 4 |
| sodium alkylaryl sulphonate | 0.6 |
| hydroquinone | 0.8 |
| water | 2.5 |
| The compressive strength was (kg/cm²): | |
| after 1 hr | 2.5 |
| after 3 hrs | 5.0 |
| after 24 hrs | 15.0 |

EXAMPLE 13

The ingredients of the composition were as follows (parts by weight):

| | |
|---|---|
| quartz sand | 100 |
| sulphite lye solids with a density of 1.22 g/cm³ and a lignosulfonate content of 43% | 4.3 |
| hydroquinone | 0.6 |
| potassium permanganate | 1.0 |
| water | 2.5 |

Upon drying standard test pieces 50 mm high and with a diameter of 50 mm at 170° C. for 2 hrs, the compressive strength was 1 kg/cm².

EXAMPLE 14

The ingredients of the composition were as follows (parts by weight):

| | |
|---|---|
| quartz sand | 100 |
| sulphite lye solids with a density of 1.22 g/cm³ and a lignosulphonate content of 43% | 4.2 |
| hydroquinone | 0.6 |
| manganese dioxide | 1.0 |
| water | 2.5 |

Upon drying standard test pieces 50 mm high and with a diameter of 50 mm at 170° C. for 2 hrs, the compressive strength was 11.5 kg/cm².

EXAMPLE 15

The ingredients of the composition were as follows (parts by weight):

| | |
|---|---|
| quartz sand | 100 |
| sulphite lye solids with a density of 1.22 g/cm³ and a lignosulphonate content of 43% | 4.2 |
| hydroquinone | 0.6 |
| titanium dioxide | 1.5 |
| water | 2.5 |

Upon drying standard test pieces 50 mm high and with a diameter of 50 mm at 170° C. for 2 hrs, the compressive strength was 12.5 kg/m$^2$.

EXAMPLE 16

The ingredients of the composition were as follows (parts by weight):

| | |
|---|---|
| quartz sand | 100 |
| sulphite lye solids with a density of 1.22 g/cm$^3$ and a ligno-sulphonate content of 43% | 4.2 |
| hydroquinone | 0.6 |
| manganese dioxide | 1.0 |
| titanium dioxide | 1.5 |
| water | 3.0 |

Upon drying standard test pieces 50 mm high and with a diameter of 50 mm at 170° C. for 2 hrs, the compressive strength was 14 kg/cm$^2$.

EXAMPLE 17

The ingredients of the composition were as follows (parts by weight):

| | |
|---|---|
| quartz sand | 90 |
| portland cement | 10 |
| sulphite lye solids with a density of 1.22 g/cm$^3$ and a ligno-sulphonate content of 43% | 4 |
| hydroquinone | 0.9 |
| potassium permanganate | 0.5 |
| titanium dioxide | 1.5 |
| water | 2.0 |
| The compressive strength was (kg/cm$^2$): | |
| after 1 hr | 8.5 |
| after 3 hrs | 14 |
| after 24 hrs | 25 |

EXAMPLE 18

The ingredients of the composition were as follows (parts by weight):

| | |
|---|---|
| quartz sand | 90 |
| portland cement | 10 |
| sulphite lye solids with a density of 1.22 g/cm$^3$ and a ligno-sulphonate content of 43% | 4 |
| hydroquinone | 0.9 |
| potassium permanganate | 0.5 |
| manganese dioxide | 1.0 |
| water | 2.0 |
| The compressive strength was (kg/cm$^2$): | |
| after 1 hr | 8.5 |
| after 3 hrs | 13 |
| after 24 hrs | 24 |

EXAMPLE 19

The ingredients of the composition were as follows (parts by weight):

| | |
|---|---|
| quartz sand | 90 |
| portland cement | 10 |
| sulphite lye solids with a density of 1.22 g/cm$^3$ and ligno-sulphonate content of 43% | 4.0 |
| hydroquinone | 0.9 |
| manganese dioxide | 1.0 |
| titanium dioxide | 1.5 |
| water | 2.0 |
| The compressive strength was (kg/cm$^2$): | |
| after 1 hr | 6 |
| after 3 hrs | 15 |
| after 24 hrs | 27 |

EXAMPLE 20

The ingredients of the moulding composition in liquid form were as follows (parts by weight):

| | |
|---|---|
| quartz sand | 90 |
| portland cement | 10 |
| sulphite lye solids with a density of 1.22 g/cm$^3$ and a ligno-sulphonate content of 43% | 4 |
| hydroquinone | 0.8 |
| titanium dioxide | 0.9 |
| sodium alkylaryl sulphonate | 0.6 |
| water | 2.5 |

The compressive strength of the liquid moulding composition was (kg/cm$^2$):

| | |
|---|---|
| after 1 hr | 3.0 |
| after 3 hrs | 5.5 |
| after 24 hrs | 17 |

EXAMPLE 21

The ingredients of the moulding composition in liquid form were as follows (parts by weight):

| | |
|---|---|
| quartz sand | 90 |
| portland cement | 10 |
| sulphite lye solids with a density of 1.22 g/cm$^3$ and a ligno-sulphonate content of 43% | 4 |
| hydroquinone | 0.9 |
| manganese dioxide | 0.8 |
| titanium dioxide | 0.9 |
| sodium alkylaryl sulphonate | 0.6 |
| water | 3.0 |

the compressive strength of the liquid moulding composition was (kg/cm$^2$):

| | |
|---|---|
| after 1 hr | 3.5 |
| after 3 hrs | 6.5 |
| after 24 hrs | 17.0 |

EXAMPLE 22

The ingredients of the composition were as follows (parts by weight):

| | |
|---|---|
| quartz sand | 95 |
| portland cement | 5 |
| sulphite lye solids with a density of 1.22 g/cm$^3$ and a ligno-sulphate content of 43% | 4 |
| hydroquinone | 0.4 |
| resorcin | 0.4 |
| water | 0.5 |

Upon blowing off the moulding composition with carbon dioxide for 10 to 15 min, the compressive strength reached 20 kg/cm$^2$.

What is claimed is:

1. A moulding composition for making self-setting foundry moulds and cores comprising foundry sand as a filler, a substance selected from the group consisting of ligno-sulphonates of alkali metals, alkali earth metals, ammonium and mixtures of said ligno-sulphonates as a binding ingredient; and a phenolic compound selected from the group consisting of phenol, pyrocatechin, resorcinol, hydroquinone, pyrogallol, phloroglucine, oxyhydroquinone, ortho-cresol, metal-cresol, para-cresol, and mixtures thereof as an additive.

2. A moulding composition as claimed in claim 1 in which the phenol is compound is contained in an amount of from 0.05 to 5% by weight of the foundry sand.

3. A moulding composition for making self-setting foundry moulds and cores comprising foundry sand as a filler; a substance selected from the group consisting of ligno-sulphonates of alkali metals, alkali earth metals, ammonium and a mixture of said ligno-sulphonates as a binding ingredient; and a phenolic compound selected from the group consisting of phenol, pyrocatechnin, resorcinol, hydroquinone, pyrogallol, phloroglucine, oxyhyroquinone, ortho-cresol, meta-cresol, para-cresol, and mixtures thereof as an additive; said phenolic compound being contained in an amount of from 0.05 to 5% by weight of the foundry sand while the phenolic compound-to-ligno-sulphonate ration is from 1:3 to 1:7.

4. A moulding composition as claimed in claim 3 wherein the phenolic compound is hydroquinone, with the hydroquinone-to-ligno-sulphonate ratio being 1:3.

5. A moulding composition as claimed in claim 3 wherein the phenolic compound is resorcinol, with the resorcinol-to-ligno-sulphonate ratio being 1:4.

6. A moulding composition as claimed in claim 3 which containes a hydraulic binder selected from the group consisting of portland cement, alumina cement, metallurgical slags and mixtures thereof in an amount of from 0.5 to 10% by weight of the foundry sand.

7. A moulding composition as claimed in claim 6 in which the hydraulic binder is portland cement.

8. A moulding composition as claimed in claim 6 in which the hydraulic binder is metallurgical slag.

9. A moulding composition as claimed in claim 6 which contains an oxidizer selected from the group consisting of potassium permanganate and hydrogen peroxide in an amount of from 0.01 to 2.0% by weight of the foundry sand.

10. A moulding composition as claimed in claim 9 in which the oxidizer is potassium permanganate.

11. A moulding composition for making self-setting foundry moulds and cores comprising foundry sand as a filler; a substance selected from a group consisting of ligno-sulphonates of an alkali metal, an alkali earth metal, an ammonium and mixtures of said ligno-sulphonates as a binding ingredient; and a phenolic compound selected from a group consisting of phenol, pyrocatechin, resorcinol, hydroquinone, pyrogallol, phloroglucine, oxyhydroquinone, ortho-cresol, meta-cresol, para-cresol, and mixtures thereof as an additive, with the phenol being contained in an amount of from 0.05 to 5% by weight of the foundry sand while the phenolic-compound-to-ligno-sulphonate ratio is from 1:3 to 1:7; and also comprising an oxidizer selected from the group consisting of potassium permanganate and hydrogen peroxide in an amount of from 0.01 to 2.0% by weight of the foundry sand.

12. A moulding composition for making self-setting foundry moulds and cores comprising foundry sand as a filler; a substance selected from a group consisting of ligno-sulphonates of an alkali metal, an alkali earth metal, an ammonium and mixture of said ligno-sulphonates as a binding ingredient; a phenolic compound selected from a group consisting of phenol, pyrocatechin, resorcinol, hydroquinone, pyrogallol, phloroglucine, oxyhydroquinone, ortho-cresol, meta-cresol, para-cresol, and mixtures thereof as an additive, with the phenolic compound being contained in an amount of from 0.05 to 5% by weight of the foundry sand while the phenolic-compund-to-ligno-sulphonate ratio is from 1:3 to 1:7; and also comprising a metal oxide selected from the group consisting of manganese dioxide, iron oxide and cuprous oxide taken in an amount of from 0.01 to 2.0% by weight of the foundry sand.

13. A moulding composition as claimed in claim 12 in which the metal oxide is manganese dioxide.

14. A moulding composition as claimed in claim 12 which contains a hydraulic binder selected from the group consisting of portland cement, alumina cement, metalurgical slags and mixtures thereof in an amount of from 0.5 to 10% by weight of the foundry sand.

15. A moulding composition as claimed in claim 12 which contains an oxidizer selected from the group consisting of potassium permanganate and hydrogen peroxide in an amount of from 0.01 to 2% by weight of the oufoundry sand.

16. A moulding composition as claimed in claim 15 in which the oxidizer is potassium permanganate.

17. A moulding composition for making self-setting foundry moulds and cores comprising foundry sand as a filler; a substance selected from a group consisting of ligno-sulphonates of an alkali metal, an alkali earth metal, ammonium and mixtures of said ligno-sulphonates as a binding ingredient; a phenolic compound selected from a group consisting of phenol, pyrocatechin, resorcinol, hydroquinone, pyrogallol, phloroglucine, oxyhydroquinone, ortho-cresol, metal-cresol para-cresol, and mixtures thereof as an additive, the phenolic compound being contained in an amount of from 0.05 to 5% by weight of the foundry sand while the phenolic compound-to-ligno-sulphonate ratio is from 1:3 to 1:7; and also comprising amphoteric metal oxide selected from the group consisting of a titanium oxide, aluminum oxide, aluminates of an alkali metal, and zinc oxide taken in an amount of from 0.5 to 3.0% by weight of the foundry sand.

18. A moulding composition as claimed in claim 17 in which the amphoteric oxide is titanium dioxide.

19. A moulding composition as claimed in claim 17 which contains a hydraulic binder selected from the group consisting of portland cement, alumina cement, metallurgical slags and mixtures thereof in an amount of from 0.5 to 10% by weight of the foundry sand.

20. A moulding composition as claimed in claim 17 which contains an oxidizer selected from the group consisting of potassium permanganate and hydrogen peroxide in an amount of from 0.01 to 2.0% by weight of the foundry sand.

21. A moulding composition as claimed in claim 17 which contains a metal oxide selected from the group consisting of manganese dioxide, iron oxide and cuprous oxide in an amount of from 0.01 to 2.0% by weight of the foundry sand.

22. A moulding composition as claimed in claim 21 which contains a hydraulic binder selected from the group consisting of portland cement, metallurgical slags and mixtures thereof in an amount of from 0.01 to 2.0% by weight of the foundry sand and which contains an oxidizer selected from the group consisting of potassium permanganate and hydrogen peroxide in an amount of from 0.01 to 2.0% by weight of the foundry sand.

23. A moulding composition as claimed in claim 21 which contains an oxidizer selected from the group consisting of potassium permanganate and hydrogen peroxide in an amount of from 0.01 to 2.0% by weight of the foundry sand.

24. A moulding composition as claimed in claim 21 which contains a hydraulic binder selected from the group consisting of portland cement, alumina cement, metallurgical slags and mixtures thereof in an amount of from 0.01 to 2.0% by weight of the foundry sand.

25. A moulding composition for making self-setting foundry moulds and cores comprising foundry sand as a filler; a substance selected from the group consisting of ligno-sulphonates of alkali metals, alkali earth metals, ammonium and a mixture of said ligno-sulphonates as a binding ingredient; a phenolic compound selected from the group consisting of phenol, pyrocatechnin, resorcinol, hydroquinone, pyrogallol, phloroglucine, oxyhydroquinone, ortho-cresol, meta-cresol, para-cresol, and mixtures thereof as an additive in an amount of from 0.05 to 5% by weight of the foundry sand while the phenolic compound-to-ligno-sulphonate ratio is between 1:3 to 1:7; and also comprising a surfactant with foam-generating properties taken in an amount of from 0.05 to 1.0% by weight of the foundry sand.

26. A moulding composition as claimed in claim 25 in which the surfactant with foam-generating properties is sodium alkylaryl sulphonate.

27. A moulding composition as claimed in claim 25 which contains a hydraulic binder selected from the group consisting of portland cement, alumina cement, metallurgical slags and mixtures thereof in an amount of from 0.5 to 10% by weight of the foundry sand.

28. A moulding composition as claimed in claim 25 which contains an oxidizer selected from the group consisting of potassium permanganate and hydrogen peroxide in an amount of from 0.01 to 2.0% by weight of the foundry sand.

29. A moulding composition as claimed in claim 25 which contains a metal oxide selected from the group consisting of manganese dioxide, iron oxide and cuprous oxide taken in an amount of from 0.01 to 2.0% by weight of the foundry sand.

30. A moulding composition for making self-setting foundry moulds and cores comprising foundry sand as a filler; a substance selected from a group consisting of ligno-sulphonates of an alkali metal, an alkali earth metal, ammonium and mixtures of said ligno-sulphonates as a binding ingredient; a phenolic compound selected from a group consisting of phenol, pyrocatechnin, resorcinol, hydroquinone, pyrogallol, phloroglucine, oxyhydroquinone, ortho-cresol, meta-cresol, para-cresol, and mixtures thereof as an additive in an amount of from 0.05 to 5% by weight of the foundry sand while the phenolic compound-to-ligno-sulphonate ratio is from 1:3 to 1:7, and also comprising a surfactant with foam-generating properties in an amount of from 0.05 to 1.0% by weight of the foundry sand and an amphoteric metal oxide selected from the group consisting of titanium oxide, aluminum oxide, aluminates of an alkali metal, and zinc oxide taken in an amount of from 0.5 to 3.0% by weight of the foundry sand.

31. A moulding composition as claimed in claim 30 which contains a hydraulic binder selected from the group consisting of portland cement, alumina cement, metallurgical slags and mixtures thereof in an amount of from 0.5 to 10% by weight of the foundry sand.

32. A moulding composition as claimed in claim 31 which contains an oxidizer selected from the group consisting of potassium permanganate and hydrogen peroxide in an amount of from 0.01 to 2.0% by weight of the foundry sand.

33. A moulding composition as claimed in claim 30 which contains a metal oxide selected from the group consisting of manganese dioxide, iron oxide and cuprous oxide taken in an amount of from 0.01 to 2.0% by weight of the foundry sand.

34. A moulding composition as claimed in claim 33 which contains a hydraulic binder selected from the group consisting of portland cement, alumina cement, metallurigcal slags and mixtures thereof in an amount of from 0.5 to 10% by weight of the foundry sand and also contains an oxidizer selected from the group consisting of potassium permanganate and hydrogen peroxide in an amount of from 0.01 to 2.0% by weight of the foundry sand.

35. A moulding composition as claimed in claim 33 which contains a hydraulic binder selected from the group consisting of portland cement, alumina cement, metallurgical slags and mixtures thereof in an amount of from 0.5 to 10% by weight of the foundry sand.

36. A method for producing self-setting foundry moulds and cores comprising the steps of: (a) mixing a moulding composition comprising 100 parts by weight of foundry sand as a filler; from 3.0 to 7.0 parts by weight of a substance selected from the group consisting of lignosulphonates of alkali metals, alkali earth metals, and ammonium, and mixtures thereof as a binding ingredient; and from 0.05 to 5.0 parts by weight of a phenolic compound selected from the group consisting of phenol, pyrocatechin, resorcinol, hydroquinone, pyrogallol, phloroglucine, oxyhydroquinone, ortho-cresol, metal-cresol, para-cresol, and mixtures thereof as an additive; (b) preparing moulds and cores from said moulding composition; (c) drying the moulds and cores until they are set.

37. A method as claimed in claim 36 in which the moulds and cores are dried by heating to a temperature of from 160 to 180° C.

38. A method as claimed in claim 36 in which the moulds and cores are dried by blowing with air.

39. A method as claimed in claim 36 in which moulds and cores are dried by gassing with carbon dioxide.

40. A method for producing self-setting foundry moulds and cores comprising the steps of: (a) mixing a moulding composition comprising from 90.0 to 99.5 parts by weight of foundry sand as a filler; from 3.0 to 7.0 parts by weight of a substance selected from the group consisting of lignosulphonates of alkali metals, alkali earth metals, ammonium and mixtures thereof as a binding ingredient; from 0.5 to 10 parts by weight of a hydraulic binder and from 0.5 to 10 parts by weight of a phenolic compound selected from the group consisting of phenol, pyrocatechin, resorcinol, hydroquinone, pyrogallol, phloroglucine, oxyhydroquinone, ortho-cresol, meta-cresol, para-cresol, and mixtures thereof as an additive; (b) preparing moulds and cores from said moulding composition; (c) drying the moulds and cores until they are set.

41. The method as claimed in claim 40, in which the moulds and cores are dried in air.

42. The method as claimed in claim 40 in which the moulds and cores are dried by blowing with air.

43. The method as claimed in claim 40 in which the moulds and cores are dried by gassing with carbon dioxide.

* * * * *